US006698127B2

(12) United States Patent
Weber

(10) Patent No.: US 6,698,127 B2
(45) Date of Patent: Mar. 2, 2004

(54) BOTTOM OF A PISTOL MAGAZINE

(76) Inventor: Christoph Weber, Dünnernstrasse 34, CH-4702, Oensingen (CH)

( * ) Notice: Subject to any disclaimer, the term of this patent is extended or adjusted under 35 U.S.C. 154(b) by 0 days.

(21) Appl. No.: 10/239,198

(22) PCT Filed: Mar. 27, 2001

(86) PCT No.: PCT/CH01/00187

§ 371 (c)(1),
(2), (4) Date: Sep. 27, 2002

(87) PCT Pub. No.: WO01/75387

PCT Pub. Date: Oct. 11, 2001

(65) Prior Publication Data

US 2003/0037474 A1 Feb. 27, 2003

(30) Foreign Application Priority Data

Mar. 30, 2000 (CH) ..... 620/00

(51) Int. Cl.[7] ..... F41C 23/00; F41A 9/61

(52) U.S. Cl. ..... 42/71.02; 42/72; 42/49.01; 42/50

(58) Field of Search ..... 42/71.02, 72, 17, 42/21, 24, 29, 33, 37, 39, 6, 49.01, 49.02, 50

(56) References Cited

U.S. PATENT DOCUMENTS

| | | | |
|---|---|---|---|
| 2,324,125 A | 7/1943 | Van Horn et al. | 42/3 |
| 2,683,948 A | 7/1954 | Catron et al. | 42/72 |
| 3,798,818 A | 6/1974 | Casull | 42/72 |
| 4,495,720 A | 1/1985 | Bross | 42/7 |

*Primary Examiner*—J. Woodrow Eldred
(74) *Attorney, Agent, or Firm*—Greenblum & Bernstein, P.L.C.

(57) ABSTRACT

The modified magazine bottom (32 is provided with the two lateral cheeks (33' or 33") and the prisms (34' or 34") which provide for a slide fit in combination with lateral grooves existing on a pistol stock. The magazine with the magazine bottom (32) can thereby be fastened to the pistol stock and used as a support grip. The latch (32*f*) acts as a spring catch in combination with the transverse groove at the bottom of the pistol stock.

19 Claims, 3 Drawing Sheets

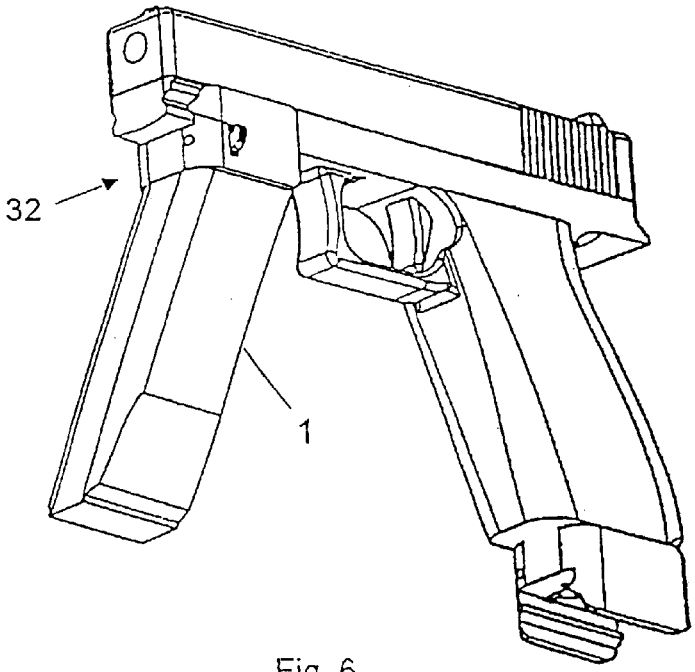
Fig. 6
Fig. 6B
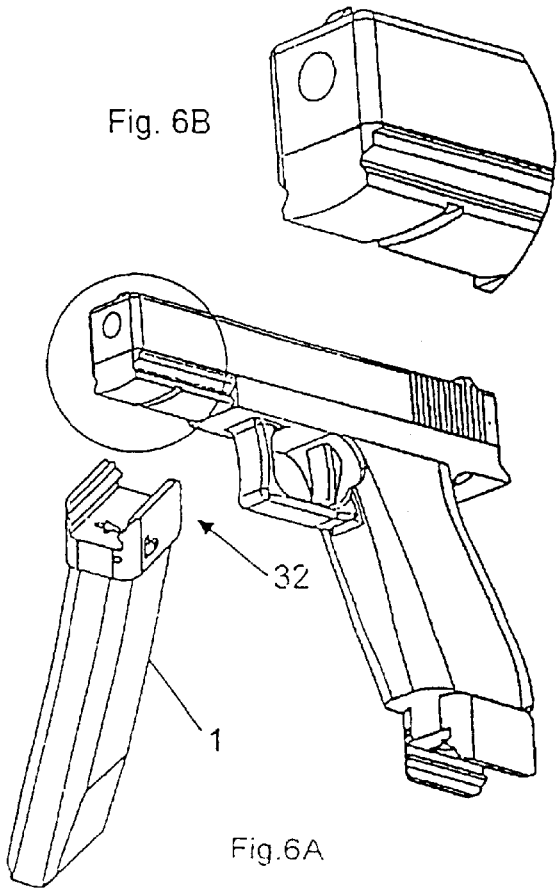
Fig.6A

BOTTOM OF A PISTOL MAGAZINE

CROSS-REFERENCE TO RELATED APPLICATIONS

The present application is a U.S. National Stage of International Application No. PCT/CH01/00187 filed Mar. 27, 2001 and claims priority of Swiss Patent Application No. 620/00 filed Mar. 30, 2000.

BACKGROUND OF THE INVENTION

1. Field of the Invention

The invention relates to a removable magazine bottom with a device for mounting a magazine via a slide fit as a pistol supporting grip.

2. Discussion of Background Information

The sureness of aim with pistols is known to be limited due to the use of a single hand, as opposed to weapons that enable aiming with both hands.

Devices for mounting a magazine via a slide fit as a pistol supporting grip are described in U.S. Pat. No. 2,324,125, and include a plate with a dovetail groove on the pistol magazine on one hand and a plate that is fixed to the bottom of the pistol and has a corresponding projection which engages in said groove in order to provide for a dovetail connection for mounting a magazine as a pistol supporting grip. However, the arrangement described here is inevitably limited to pistols which are subsequently equipped with a special plate adapted to the magazine whereby their use of a magazine as a pistol grip is greatly restricted for practical reasons.

The use of a magazine as a pistol grip is further described in U.S. Pat No. 2,683,948, while a subsequent mechanical treatment and adaptation of the pistol for mounting the magazine is required here and is thereby also greatly restricted for practical reasons.

Devices with a spring lock for mounting an auxiliary butt as a shoulder support on a pistol magazine are moreover described in U.S. Pat. No. 3,798,818.

SUMMARY OF THE INVENTION

The present invention provides a magazine bottom that largely eliminates the abovementioned problems with simple technical device and slight expenditure of work and that by itself enables mounting a magazine as a supporting grip on pistols of conventional construction, which are already provided in series production with two longitudinal V-shaped grooves existing on opposite sides of the pistol.

To this end, the magazine bottom according to the invention is characterized by the features defined in the claims.

The invention will be more fully illustrated by means of a standard magazine, an embodiment of a modified magazine body and the drawing.

BRIEF DESCRIPTION OF THE DRAWINGS

FIG. 6 is a general view of a pistol with the magazine according to FIG. 5 mounted as a support grip.

FIG. 6A shows the pistol and the magazine according to FIG: 5 in detail.

FIG. 6B shows a detail of FIG. 6A.

DETAILED DESCRIPTION OF THE DRAWINGS

Figure 1A:
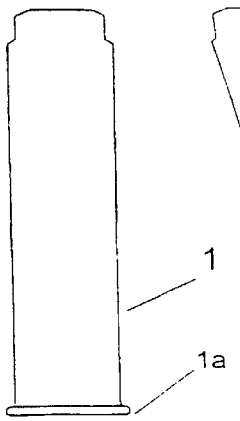
FIG. 1A is a front view of the magazine body according to FIG. 1.
Figure 1:
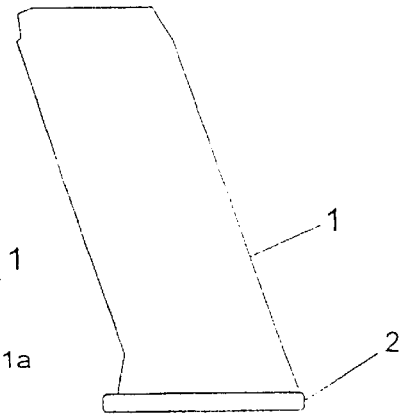
FIG. 1 shows a standard magazine with a fitted bottom of conventional design.
Figure 2:
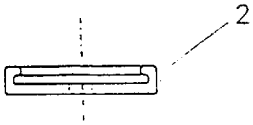
FIG. 2 is a front view of a conventional magazine bottom.
Figure 2B:
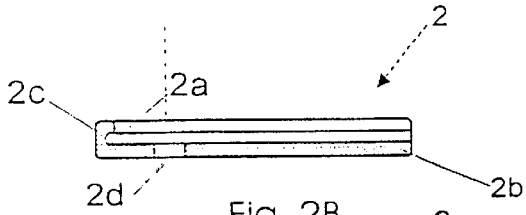
FIGS. 2A to 2C are three views of the conventional magazine bottom according to FIG. 2.
Figure 2C:
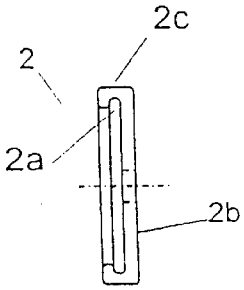
Figure 2A:
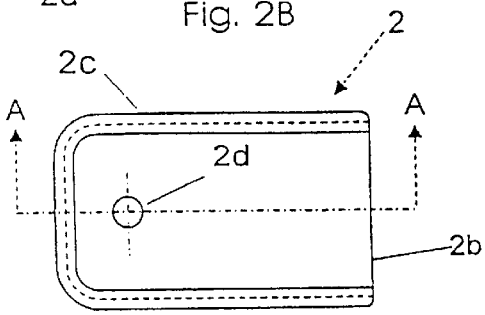
Figure 3:
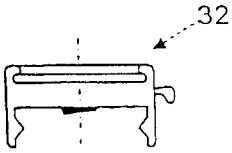
FIG. 3 is a front view of a modified magazine bottom according to the invention.
Figure 3B:
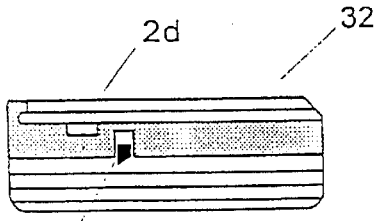
FIGS. 3A to 3C are three views of the modified magazine bottom according to FIG. 3.
Figure 3C:
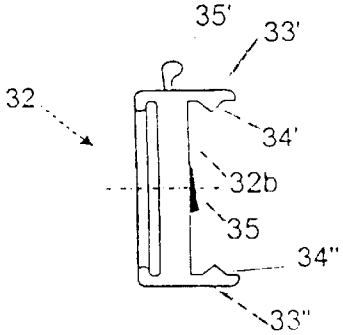
Figure 3A:
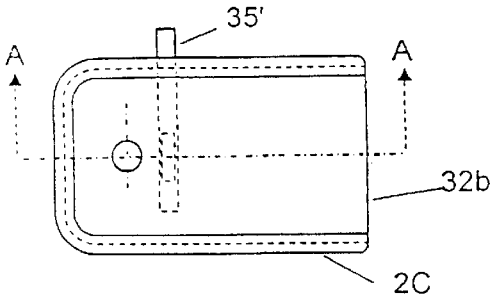

The standard magazine for pistols according to FIGS. 1 and 2 consists of a magazine of conventional design with a flange 1*a* at its bottom end and a magazine bottom 2 with a rectangular base plate 2*b* with a lateral ridge 2*a* well as a locking hole 2*d*. FIGS. 2A and 2C show that the lateral ridge 2*c* arranged in the upper portion of the base plate 2*b* associated with the magazine 1 extends over the entire length of both parallel longitudinal sides and the rounded end of the base plate 2*b* and is provided with an inner groove 2*a* adapted to the flange 1*a* of the magazine body 1, this groove 2*a* providing for a slide fit in combination with the flange 1*a* for fastening the bottom 2 to the magazine 1.

FIGS. 3 and 3A to 3C show a modified magazine bottom 32 whose part associated with the standard magazine 1 is identical with the described conventional magazine bottom 2 according to FIGS. 2 and 2A–2C.

This modified magazine bottom 32 nevertheless differs essentially from the conventional bottom 2 of the standard magazine in that it is provided with two parallel, longitudinal, lateral cheeks 33' and 33", whose inner side has in each case a prism 34' and 34" respectively, while these prisms provide for a slide fit in combination with corresponding V-grooves in the stock of a pistol, as is further described later.

A spring latch 35 is further fitted in this modified magazine bottom 32 near the rounded end of the bottom 32, protrudes from it between the lateral cheeks 33' and 33", functions as a snap lock as is further described later in combination with a corresponding transverse groove in a pistol stock and is released by means of a lever 35' protruding laterally from the magazine bottom.

Figure 4A:
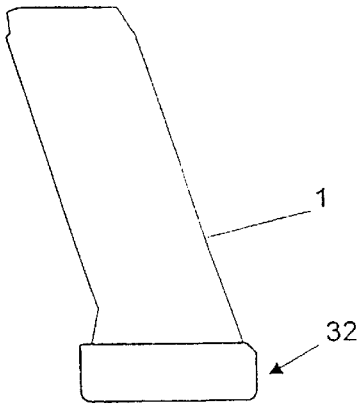
FIG. 4A shows a magazine with a modified magazine bottom according to FIGS. 3 to 3C.
Figure 4B:
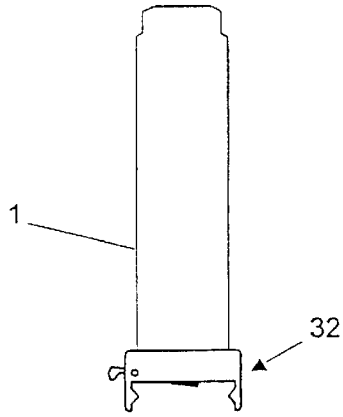
FIG. 4B is a front view of the magazine with a magazine bottom according to FIG. 4A.

The magazine 1 combined with the modified magazine bottom 32 is represented in FIGS. 4A and 4B.

Figure 5:
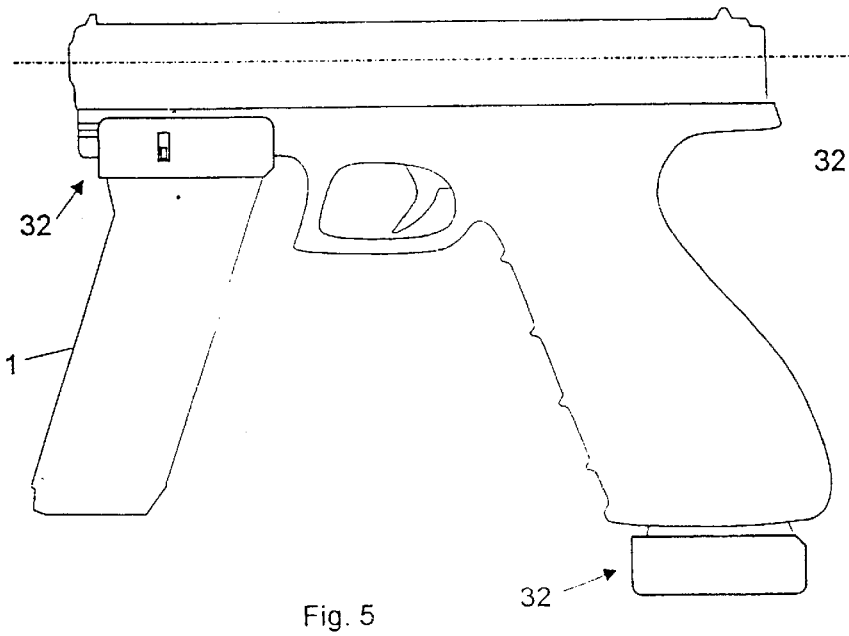
FIG. 5 shows a pistol with a magazine according to FIGS. 4A and 4B mounted as a supporting grip.
Figure 5A:
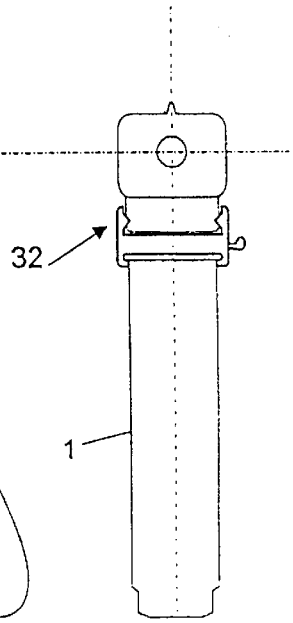
FIG. 5A is a front view of the pistol with the mounted magazine according to FIG. 5.

FIG. 5 shows schematically how a magazine 1 with the modified magazine bottom 32 is mounted upside-down on the pistol stock.

Further details of the arrangement of the magazine as a supporting grip on a pistol may also be seen from the general view in FIGS. 6 as well as 6A and 6B.

What is claimed is:

1. A magazine bottom with an outer face adapted to connect a magazine to a pistol to thereby provide an auxiliary pistol-supporting grip, wherein:

(a) the magazine bottom is provided with a pair of parallel side walls projecting from said outer face of the magazine bottom and said parallel side walls are adapted to connect the magazine bottom to opposite sides of a pistol of the type having a pair of longitudinal V-shaped grooves existing on either side and further having a transverse recess on the underside of each pistol of said type, (b) each side wall of said pair of parallel side walls is provided with an inward V-shaped projection adapted to engage one of said longitudinal V-shaped grooves of the pistol and to thereby firmly connect said magazine to both sides of a pistol of said type.

2. The magazine bottom according to claim 1, said magazine bottom containing a spring lock having a lateral lever projecting from a side of the magazine bottom, said spring lock having a latch adapted to engage a corresponding transverse recess existing at the bottom of a pistol of said type, so that this spring lock in combination with said recess functions as a snap lock that may be released via said lateral lever.

3. A magazine bottom with an outer face adapted to connect a magazine to a pistol to thereby provide an auxiliary pistol-supporting grip, wherein:

(a) the magazine bottom is provided with a pair of parallel side walls projecting from said outer face of the magazine bottom and said parallel side walls are adapted to connect the magazine bottom to opposite sides of a pistol of the type having a pair of longitudinal V-shaped grooves existing on either side and further having a transverse recess on the underside of each pistol of said type, (b) each side wall of said pair of parallel side walls is provided with an inward V-shaped projection adapted to engage one of said longitudinal V-shaped grooves of the pistol and to thereby firmly connect said magazine to both sides of a pistol of said type, and (c) the magazine bottom contains a spring lock having a lateral lever projecting from a side of the magazine bottom, said spring lock having a latch adapted to engage said transverse recess existing at the bottom of each pistol of said type, so that this spring lock in combination with said recess functions as a snap lock that may be released via said lateral lever.

4. A removable magazine bottom for removably mounting a magazine to a pistol whereby the magazine can serve as a pistol supporting grip when the magazine is mounted to the pistol via the magazine bottom, the magazine bottom comprising:

a first end adapted to be removably connected to a magazine having a flange;

a second end adapted to be removably connected to a portion of a pistol having two oppositely arranged symmetrical longitudinal V-shaped grooves;

the second end comprising two projecting side walls which are arranged parallel to one another;

each of the two projecting side walls comprising an inwardly projecting symmetrical V-shaped projection, wherein each V-shaped projection is adapted to slide into each longitudinal V-shaped groove of the pistol when the magazine is mounted to the pistol so as to serve as a pistol supporting grip.

5. The magazine bottom of claim 4, wherein the first end comprises a lateral ridge and an inner groove which can receive therein the flange of the magazine.

6. The magazine bottom of claim 5, wherein the lateral ridge is arranged on three lateral sides.

7. The magazine bottom of claim 5, wherein the lateral ridge is a continuous lateral ridge that is arranged on three lateral sides.

8. The magazine bottom of claim 5, wherein the inner groove is arranged on opposite lateral sides.

9. The magazine bottom of claim 5, wherein the inner groove is arranged on three lateral sides.

10. The magazine bottom of claim 5, wherein the inner groove is a continuous inner groove that is arranged on three lateral sides.

11. The magazine bottom of claim 5, wherein each of the two projecting side walls comprises a planar outwardly facing surface.

12. The magazine bottom of claim 5, wherein each inwardly projecting V-shaped projection is spaced from a free end of each of the two projecting side walls.

13. The magazine bottom of claim 12, further comprising a first-planar surface arranged between the inwardly projecting V-shaped projection and the free end.

14. The magazine bottom of claim 13, further comprising a second planar surface arranged between the inwardly projecting V-shaped projection and a bottom surface of the second end.

15. The magazine bottom of claim 14, wherein the bottom surface of the second end is arranged opposite a bottom surface of the first end.

16. The magazine bottom of claim 4, further comprising a mechanism for locking the magazine bottom to the pistol.

17. The magazine bottom of claim 16, wherein the mechanism comprises a spring lock having a lateral lever that projects from a side wall, whereby the spring lock is adapted to engage a corresponding recess of the pistol.

18. The magazine bottom of claim 4, wherein the first end comprises a lateral ridge, a bottom surface, and an inner groove disposed between the lateral ridge and the bottom surface, wherein the inner groove can receive therein the flange of the magazine, and wherein the lateral ridge and the inner groove are arranged on three sides of the first end.

19. The magazine bottom of claim 18, further comprising a mechanism for locking the magazine bottom to the pistol.

* * * * *